US006036525A

United States Patent [19]

Alfis, III

[11] Patent Number: 6,036,525

[45] Date of Patent: Mar. 14, 2000

[54] SEALABLE ENCLOSURE FOR ELECTRICAL CABLE CONNECTORS

[76] Inventor: Michael V. Alfis, III, 680 Meisten St., Washington Township, N.J. 07675

[21] Appl. No.: 09/184,469

[22] Filed: Nov. 2, 1998

[51] Int. Cl.[7] ..... H01R 13/62

[52] U.S. Cl. ..... 439/367; 439/371

[58] Field of Search ..... 439/367, 369, 439/371, 465, 466, 467, 521

[56] References Cited

U.S. PATENT DOCUMENTS

| | | | |
|---|---|---|---|
| D. 338,190 | 8/1993 | Bradbury | 439/472 |
| 3,014,194 | 12/1961 | Berglund | 439/367 |
| 3,879,575 | 4/1975 | Dobbin et al. | 439/521 |
| 4,143,934 | 3/1979 | Siebert | 439/367 |
| 4,643,505 | 2/1987 | House et al. | 439/367 |
| 4,702,541 | 10/1987 | Arnold | 439/403 |
| 4,869,683 | 9/1989 | Nelson | 439/369 |
| 5,217,387 | 6/1993 | Hull | 439/367 |
| 5,306,176 | 4/1994 | Coffey | 439/367 |
| 5,502,280 | 3/1996 | Rocci et al. | 439/271 |
| 5,551,888 | 9/1996 | Rhodes, Sr. | 439/367 |

*Primary Examiner*—Hien Vu

*Attorney, Agent, or Firm*—Ostrolenk, Faber, Gerb & Soffen, LLP

[57] ABSTRACT

An enclosure for protecting mating end connectors of electrical cables comprising, a housing, the housing having two ends, each end having a closable opening allowing a connector of an electrical cable to be passed therethrough into the housing, each opening including a cable receiving channel having a seal for sealing to a respective electrical cable, the housing adapted to receive the mating connectors of the respective electrical cables therein, each end having two opposed members adapted to be placed in sealing relationship with each other, the housing being movable from a first condition in which a connector of a first electrical cable passing through the opening at one end is exposed for connection with the connector of a second electrical cable to a second condition in which the housing fully encloses both electrical cable connectors and wherein the ends of said housing can be closed to seal both electrical cable connectors from the external environment in the housing.

10 Claims, 2 Drawing Sheets

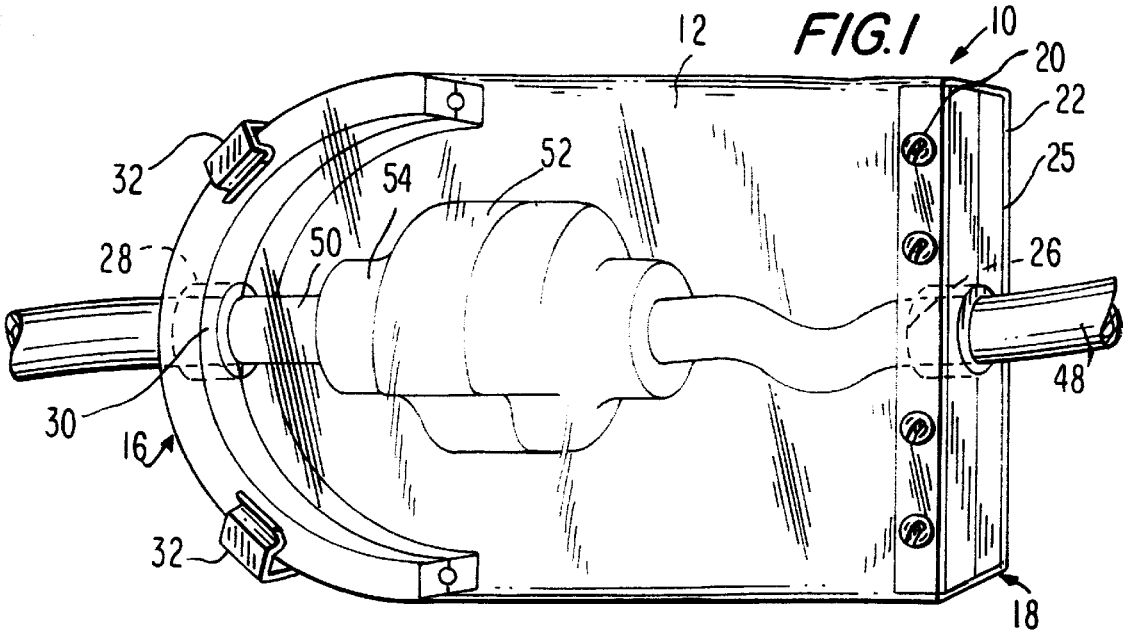
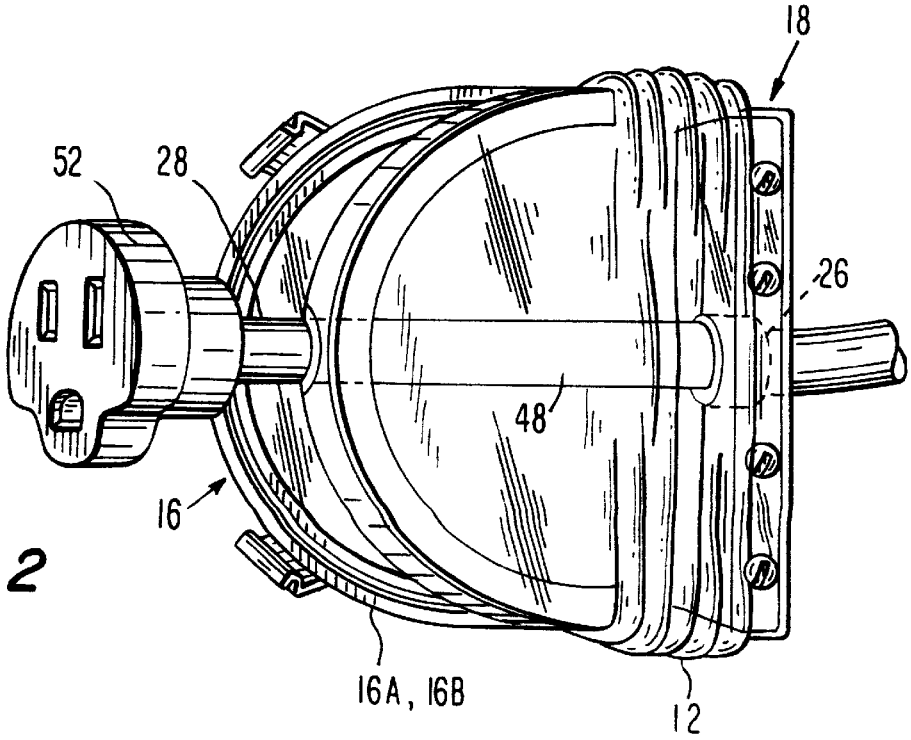
FIG.2

SEALABLE ENCLOSURE FOR ELECTRICAL CABLE CONNECTORS

CROSS REFERENCE TO RELATED APPLICATION

Reference is also made to Applicant's application Ser. No. 08/764,978 filed Dec. 13, 1996 entitled "Sealable Enclosure For Electrical Cable Connectors".

BACKGROUND OF THE INVENTION

The present invention relates to electrical cables and connectors therefore, and in particular, to a sealable enclosure for protecting the end connectors of connected electrical cables, for example, the interconnected male and female ends of electrical extension cords/electrical power tool cables, from damage due to water, moisture, dust and abrasion, for example. Furthermore, the present invention is directed to a protective enclosure which not only protects the interconnected end connections of the electrical cables, but prevents the electrical connectors from contacting water and thereby presenting an electrical shock danger. Additionally, the present invention is directed to an electrical cable connector enclosure which assists in preventing the interconnected cables from pulling apart in use.

Various patents have been obtained for protective enclosures for electrical plug connections. In particular, U.S. Pat. No. 4,869,683 to Nelson discloses such an enclosure. The enclosure of that reference, however, utilizes a flat sealing band of compressibly resilient material to seal the interior of the protective enclosure at the two locations where the electrical cords enter the enclosure. As a result, the enclosure of that reference suffers from the disadvantage of being suitable only for a limited number of sizes of electrical cords, as determined by the amount of compressibility of the resilient seal.

U.S. Pat. No. 4,643,505 to House et al. describes an extension cord connector housing which is provided primarily to prevent disconnection of the interconnected ends of the electrical extension cords. That device is not provided for the purpose of preventing electrical shock hazards due to water or moisture entering the enclosure.

U.S. Pat. No. 4,143,934 to Seibert discloses a socket and plug holder. Although that patent mentions that the holder prevents physical damage to the cords and that it protects them from drips and splashes when used, the primary purpose of that reference is not to provide a water tight enclosure and thus protect against shock hazard.

U.S. Pat. No. 5,306,176 to Coffey discloses a protector for electrical cord connections. This device includes a plurality of seals and is adapted to enclose the connected electrical cord connectors in a sealed chamber to isolate any spark or arc. However, this reference is primarily directed to provide a protector for electrical cord connections which can be quickly disconnected when required, for example, in the case of an emergency. The seals utilized in that device are intended to conform to the outside diameter of the electrical cord and provide a sealing engagement. The flexible seals are described as flexible discs but are not suited to a wide range of electrical cord thicknesses.

U.S. Pat. No. 4,702,541 to Arnold discloses an extension cord connector guard having slit type seals for each electrical cord. The slit type seals are described as slit resilient gaskets or seals and as such, are not adapted to provide water tight seals for a wide variety of extension cord thicknesses.

U.S. Pat. No. Des. 338,190 to Bradbury discloses a plug skid for an electrical cord.

There is a need for a protective water-tight enclosure for the interconnected connectors of electrical cables, for example, interconnected electrical extension cords/electrical power tool cables, which can be used in locations where the connectors may come into contact with water, for example, at construction sites, and which provides such an enclosure for electrical cables of varying thickness.

SUMMARY OF THE INVENTION

It is, accordingly, an object of the present invention to provide an enclosure for the electrical connectors of interconnected electrical cables such as extension cords/electrical power tool cables.

Yet still a further object of the present invention is to provide such an enclosure which is water tight.

Yet still another object of the present invention is to provide such an enclosure which provides a protective enclosure for the connections of interconnected electrical cables such as extension cords and which can be used, for example, at construction sites.

Yet still a further object of the present invention is to provide such an enclosure for the connectors of electrical cables such as extension cords which eliminates shock hazards due to water.

Yet still a further object of the present invention is to provide such an enclosure for the connectors of electrical cables which is convenient to use.

It is yet still a further object of the present invention to provide an enclosure for the connectors of interconnected electrical cables which aids in preventing the electrical connections from disconnecting in use.

The above and other objects of the present invention are achieved by an enclosure for protecting mating end connectors of electrical cables comprising a housing, the housing having two ends, each end having a closable opening allowing a connector of an electrical cable to be passed therethrough into the housing, each opening including a cable receiving channel having a seal for sealing to a respective electrical cable; the housing adapted to receive mating connectors of the respective electrical cables therein; each end having two opposed members adapted to be placed in sealing relationship with each other; the housing being movable from:

a first condition in which a connector of a first electrical cable passing through the opening at one end is exposed for connection with the connector of a second electrical cable to:

a second condition in which the housing fully encloses both electrical cable connectors; and wherein the ends of said housing can be closed to seal both electrical cable connectors from the external environment in said housing.

Other objects, features and advantages of the present invention will be apparent from the detailed description which follows.

BRIEF DESCRIPTION OF THE DRAWINGS

The invention will now be described in greater detail in the following detailed description with reference to the drawings, in which:

FIG. 1 is a perspective phantom view, partially in phantom, showing the protective water tight enclosure for the connectors of interconnected electrical cables according to the present invention in a closed condition;

FIG. 2 shows, in a perspective view, the protective enclosure according to the present invention in an opened condition with an electrical connector exposed prior to making the connection with a mating connector of another electrical cable;

DETAILED DESCRIPTION OF EMBODIMENTS OF THE INVENTION

Figure 4:
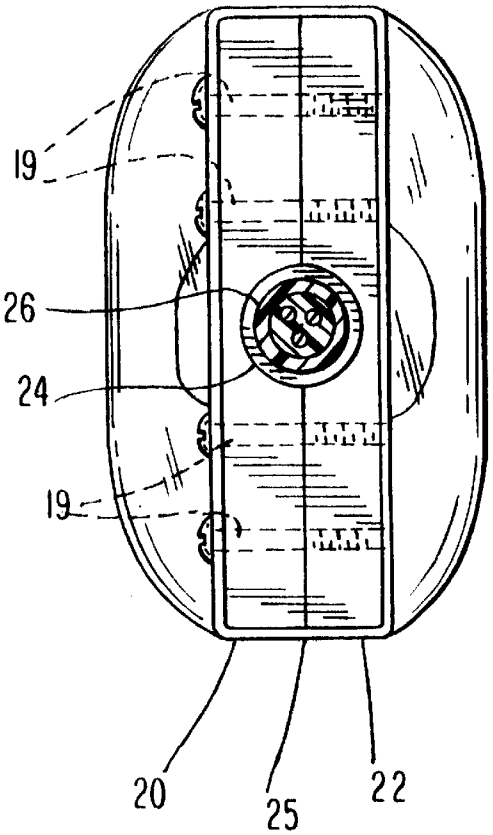
FIG. 4 is a view of one end of the enclosure of the invention.
Figure 3:
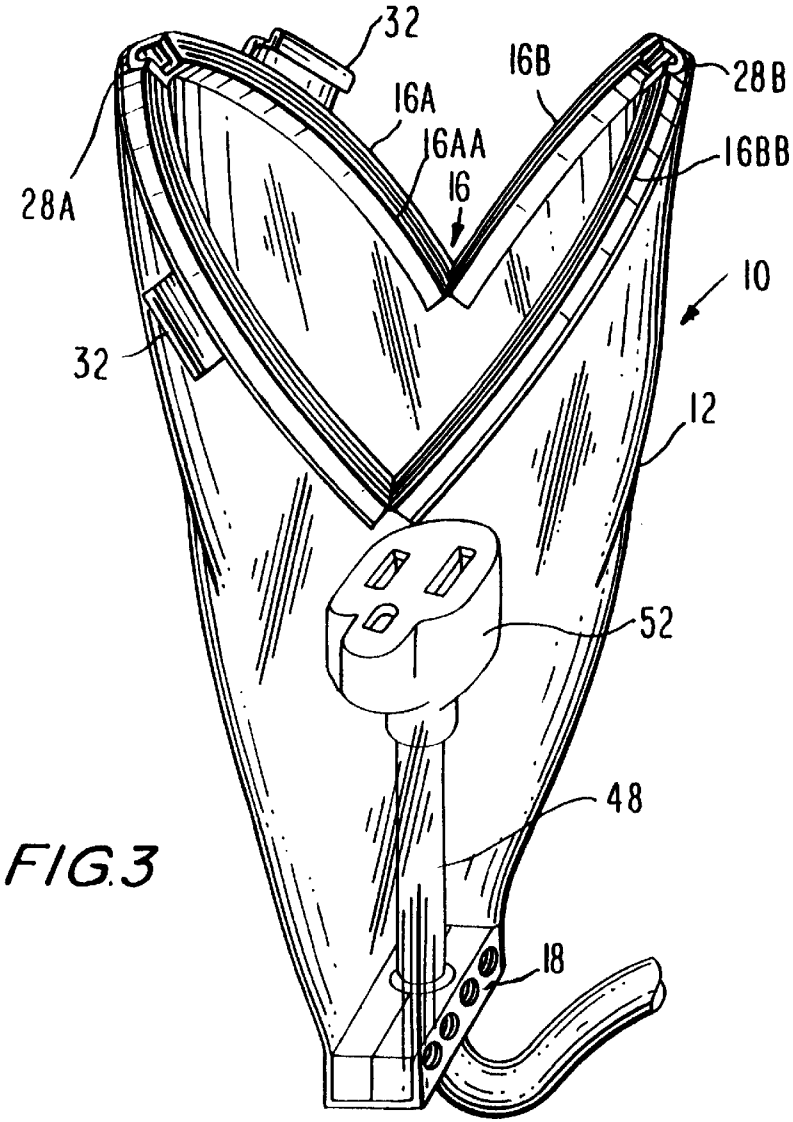
FIG. 3 shows, in perspective view, the protective enclosure according to the present invention in an opened condition but with the electrical connector of one cable disposed inside the housing.

With reference now to the drawings, the figures show the protective water tight enclosure for the connectors of interconnected electrical cables, such as extension cords, according to the present invention. In the preferred embodiment, the enclosure, generally indicated at 10 in the drawings, comprises a housing 12 comprising a flexible bag made of a water impervious material, for example, a flexible plastic or rubber material. The bag 12 can be opaque or transparent. The bag 12 includes a first end 16 which has an openable mouth and a second end 18. Both ends are openable. Preferably, end 16 is made to be openable without the use of tools, i.e., end 16 has quick release type fasteners, described in detail later. End 18 may be made openable without the use of tools also, but is preferably semi-permanently closed, i.e., tools are required to open end 18 and once an electrical cable with connector end is inserted through the opening into the housing 12, it is closed, as by means of screws 19. In this way it is assured that once the enclosure of the invention is applied to an electrical cable, it remains with the cable unless it is thereafter deliberately removed. According to another embodiment, the fasteners 19 may be rivets or some other permanent fastener, in which case, the device 10 is permanently affixed to the electrical cable 48.

The second end 18 includes a fixed seal comprising two plate members 20 and 22 which when joined together by suitable means such as screws 19, form a channel 24 therein for receiving and sealing to an electrical cable 48 whose connector 52 has already been inserted into housing 12 through end 18. Connector 52 may be the receptacle end of an electrical extension cord. Although the means to secure the plate members 20 and 22 together may be, for example, screws 19, any other fastener, such as a snap fastener, may be used. Between the two plates 20 and 22, a seal 25 is formed preventing water from entering the interior of the housing 12. A circular seal 26 at channel 24 provides a water impervious seal with the electrical cable 48. Preferably, the sealing material 26 is a formable, non-resilient sealant. The seal is preferably made of a material like a gum/rubber compound or nondrying caulking which can be formed, for example, by hand, to assume the shape of the space between the electrical cable 48 and the internal dimension of the opening 24. Preferably the seal 26 does not have resilience to return to its former shape. In this way an effective water-tight seal can be obtained between the electrical cable 48 and the opening 24. Sealing material 26 may be a poster adhesive called Kwik-Fix manufactured by Chemence of Alpharetta, Ga. Any other suitable moldable, non-resilient, non-flowable, water impervious material, preferably which does not dry out, may be used.

Although the seal is preferably a formable inelastic material, it can also be made of a resilient material which is sized such that it will form a seal with the electrical cable 48, and preferably electrical cables of varying size. A flexible apertured diaphragm formed of two half annular segments could be employed.

At the end 16 of the housing 12, an openable mouth is formed by two opposed members 16A and 16B which include a seal, for example 16AA disposed on at least one of the members. An additional seal 16BB may be installed on the member 16B. However, it is only necessary to have one seal on one of the members 16A and 16B. When the two members 16A and 16B are brought together to close the opening, a water-tight seal is formed. At the center of each of the members 16A and 16B, a semi-circular opening 28A and 28B, respectively, is provided. When the members 16A and 16B are closed upon each other, a circular channel 28 for the second electrical cable 50 whose connector 54 connects with the connector 52 of the other electrical cable 48 is thus provided. As with the opening 24 at the other end 18, a sealing member 30 is provided in each of the semi-circular openings 28A and 28B. The seal 30 is preferably an inelastic moldable material like the preferred material of the seal 26, so that it can be molded to the electrical cables 50 each time the end 16 is opened and so as to be adaptable to cables 50 of varying thickness or multiple cables such as a Christmas light cable or a plurality of such cables. Each time a cable 50 is passed through end 18, the seal 30 is remolded to seal to the cable 50.

Seal 30 can also be a resilient or elastic material, and if so, preferably sized to fit varying size electrical cables, like seal 26.

Releasable latches or snap fasteners 32 are preferably provided to hold the members 16A and 16B together.

In accordance with the described design, end 16 is thus releasably openable by undoing latches or snap fasteners 32. End 18 preferably is semi-permanently mounted on cable 48 so that the enclosure 12 remains with cable 48. However, end 18 may be made similarly to end 16, so that it can be opened by undoing snap fasteners and the entire enclosure 12 removed from the cable 48.

FIG. 1 shows the device of the present invention in use. FIG. 2 shows the device of the present invention prior to connection of the two connectors 52 and 54, showing the bag enclosure 12 folded back to expose connector 52. The view of FIG. 2 also shows a storage position for enclosure 12. The flexible housing 12, preferably a bag, is folded or pushed back much like an accordion, toward the end 18 and the members 20 and 22 thereof. The sealing members 16A and 16B are moved past the connector 52 of the cable 48 thus exposing the connector 52. The connector 54 of the second cable 50 is then connected to the connector 52 and the housing 12 is then moved back so that the two connectors 52 and 54 are disposed within the housing 12. The two members 16A and 16B are thereafter placed into sealing relationship. The seal 16AA/16BB is preferably a neoprene, rubber, plastic or like substance seal, so that it can be easily cleaned to maintain proper sealing. The seal 16AA/16BB may also be the type of seal known as a zip-lock seal, although this is not preferable because of difficulties encountered if the seal comes into contact with dirt or other foreign matter.

When the members 16A and 16B are placed in sealing relationship, the electrical cable 50 is fitted in the half openings 28A and 28B in the two members 16A and 16B and the cable 50 is sealed to the channel 28 formed by the half openings 28A and 28B by seal 30. The connected electrical cables 48 and 50 and the connectors 52 and 54 thereof are now sealed from the environment, minimizing the chance of electrical shock. In addition, the connectors 52 and 54 are protected from damage by being enclosed in the housing 12, which preferably is made of an impact resistant material. Furthermore, the enclosure of the connectors 52 and 54 within the housing 12 helps to minimize accidental disengagement of the connectors.

The seals 26 and 30, as discussed, are preferably made of a material like a gum rubber compound or a non-drying caulking which can be formed, molded or kneaded, for example, by hand, to assume the shape of the space between the inner diameter of channels 24, 28 and the external dimension of the electrical cable and which does not have resilience to return to its former shape. In this way, an effective water tight seal can be obtained to each cable.

The seals 25, 16AA, 16BB are made of a different material, in contrast. These seals may be resilient and compressible since they do not need to assume the shape of electrical cables of varying dimensions. The seals 25, 16AA, 16BB may be made so they can be replaced, as necessary. However, these seals are reusable in ordinary use. As discussed above, they can be made of neoprene, plastic, rubber or a like material. Only one opposed surface needs to have a resilient seal. The other opposed surface can be a smooth surface. Alternatively, both opposed surfaces can have resilient seals as shown. Furthermore, other type seals, such as a Zip-Lock™ seal, can be used.

Seals 26 and 30 may have to be remolded each time a new electrical cable is inserted through the respective channels 24, 28.

The bag 12 is preferably made so that it can accommodate electrical cable connectors, such as connection 52 and 54, of varying size. The bag 12 preferably comprises a sheet or a plurality of separate or laminated sheets of 4 to 8 mil plastic sheeting, preferably with ultraviolet protection to prevent degradation due to sunlight. The seals 25, 16AA, 16BB may be mating portions of a sealable connector, such as a longitudinal tongue and groove snap seal, also known as a Zip-Lock™ seal. A plurality of such longitudinal tongue and groove seals may be provided to ensure a water-tight seal.

There has thus been described a water-tight enclosure for the interconnected end connectors of electrical cables such as extension cords/electrical power tool cables. The enclosure is water tight, thereby preventing the connectors from being exposed to moisture, for example, at construction sites, and thereby preventing shock hazards. The enclosure according to the present invention also helps to maintain the connectors 52 and 54 in electrical connecting relationship, thereby saving the time attendant to having to reconnect the connectors 52 and 54 when in use. The protective enclosure according to the present invention is adapted to receive electrical extension cords of varying thickness and yet provides an effective water-tight seal around the extension cord connectors due to the use of a formable non-resilient seal at the channels 24 and 28. The invention also protects the connectors from damage due to abrasion, etc. Further, because of the preferred semi-permanent connection at end 18 to one of the electrical cables, once the invention 10 is installed on a cable, it remains with the cable, thus helping to ensure use of the invention and obtaining the benefits of the invention.

Although the present invention has been described as comprising a housing 12 with two ends having separate members 20, 22 and 16A and 16B in sealing relationship, the entire structure can be made as a unitary molded structure, for example, of plastic with the bag 12 being flexible or pleated to allow folding and opposed members 20 and 22 at end 18 and 16A and 16B at end 16 being integrated with bag 12. In such case, appropriate seals can be provided on the structure to allow it to be opened and closed.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An enclosure for protecting mating ends of electrical cable connectors comprising:

a flexible housing, the housing having two ends, each end having a closable opening allowing one of said electrical cable connectors to be passed therethrough into the housing, each opening including a cable receiving channel having a member for sealing to a respective electrical cable;

the housing adapted to receive the mating ends of the respective electrical cable connectors therein;

each of said ends of said housing having two opposed members adapted to be placed in sealing relationship with each other;

the housing being foldable from a first condition in which a first electrical cable connector passing through the opening at one of said ends of said housing is exposed so that a connection between said first electrical cable connector and a second electrical cable connector can be achieved to a second condition in which the housing is folded back to fully enclose both electrical cable connectors; and wherein the ends of said housing can be closed into a closed condition to seal both electrical cable connectors from the external environment in said housing;

wherein the two opposed members at each end have a sealing surface for sealing engagement with an opposed surface of the opposed member; wherein each opposed member has a semi-circular opening which together form the cable receiving channel when the opposed members are placed in sealing engagement into which electrical cables can be disposed, said sealing members being provided for sealing to the electrical cables;

wherein the sealing members for sealing to the electrical cables comprise an inelastic moldable seal.

2. The enclosure of claim 1, wherein at least one of the sealing surfaces further comprises a resilient seal.

3. The enclosure of claim 1, wherein the opposed members at least at one end are held together in the closed condition by a releasable snap-lock fastener.

4. The enclosure of claim 1, wherein the opposed members at least at one end are held together by a screw fastener.

5. The enclosure of claim 1, wherein the cable receiving channel at least at one end is adapted to receive a range of electrical cables of varying thickness and the sealing member is formable to provide a water tight seal with the cable.

6. The enclosure of claim 1, wherein the sealing surface comprises a strip seal.

7. The enclosure of claim 1, wherein a closable opening at one end, once closed about an electrical cable, is permanently closed and attached to the cable.

8. The enclosure of claim 7, wherein the opposed members at the permanently closed end are held together by at least one rivet.

9. The enclosure of claim 1, wherein both ends are releasably openable.

10. The enclosure of claim 1, wherein only one end is releasably openable.

* * * * *